United States Patent [19]

Nyquist

[11] 4,125,078

[45] Nov. 14, 1978

[54] CLOTHING ROD/SHELF SUPPORT UNIT

[76] Inventor: Lawrence M. Nyquist, 3018 N. Spaulding, Chicago, Ill. 60618

[21] Appl. No.: 822,383

[22] Filed: Aug. 5, 1977

[51] Int. Cl.[2] ..... A47B 61/00

[52] U.S. Cl. ..... 108/29; 248/205 R; 248/201; 211/90; 248/268

[58] Field of Search ..... 108/29, 31, 64, 114, 108/152, 102; 248/251, 254, 235, 240, 205, 240.3, 268, 241; 211/90; 312/245, 351

[56] References Cited

U.S. PATENT DOCUMENTS

| | | | |
|---|---|---|---|
| 317,242 | 5/1885 | Tatem | 248/240 |
| 1,286,588 | 12/1918 | Goodykoontz | 108/29 X |
| 2,570,097 | 10/1951 | Carbary | 248/241 X |
| 2,624,468 | 1/1953 | McCauley | 248/251 X |
| 3,478,891 | 11/1969 | Kaeslin | 211/90 X |
| 3,538,842 | 6/1968 | Labbato | 108/29 |

*Primary Examiner*—Roy D. Frazier
*Assistant Examiner*—Peter A. Aschenbrenner
*Attorney, Agent, or Firm*—Richard G. Lione; Peter E. Heuser

[57] ABSTRACT

A clothing rod/shelf support unit is provided having an extensible rod adapted to extend between two opposing walls, the rod including mounting means at its ends. Pivotal brackets extend from the rod to a third wall and are adapted to support a shelf above the rod. A second embodiment includes a support block mounted to the rod, with a second extensible rod extending therefrom in a direction substantially perpendicular to the first rod toward a fourth wall which is substantially perpendicular to the opposing walls. A second set of brackets extend from the second rod toward one of the opposing walls and are adapted to support a second shelf.

14 Claims, 9 Drawing Figures

FIG. 8
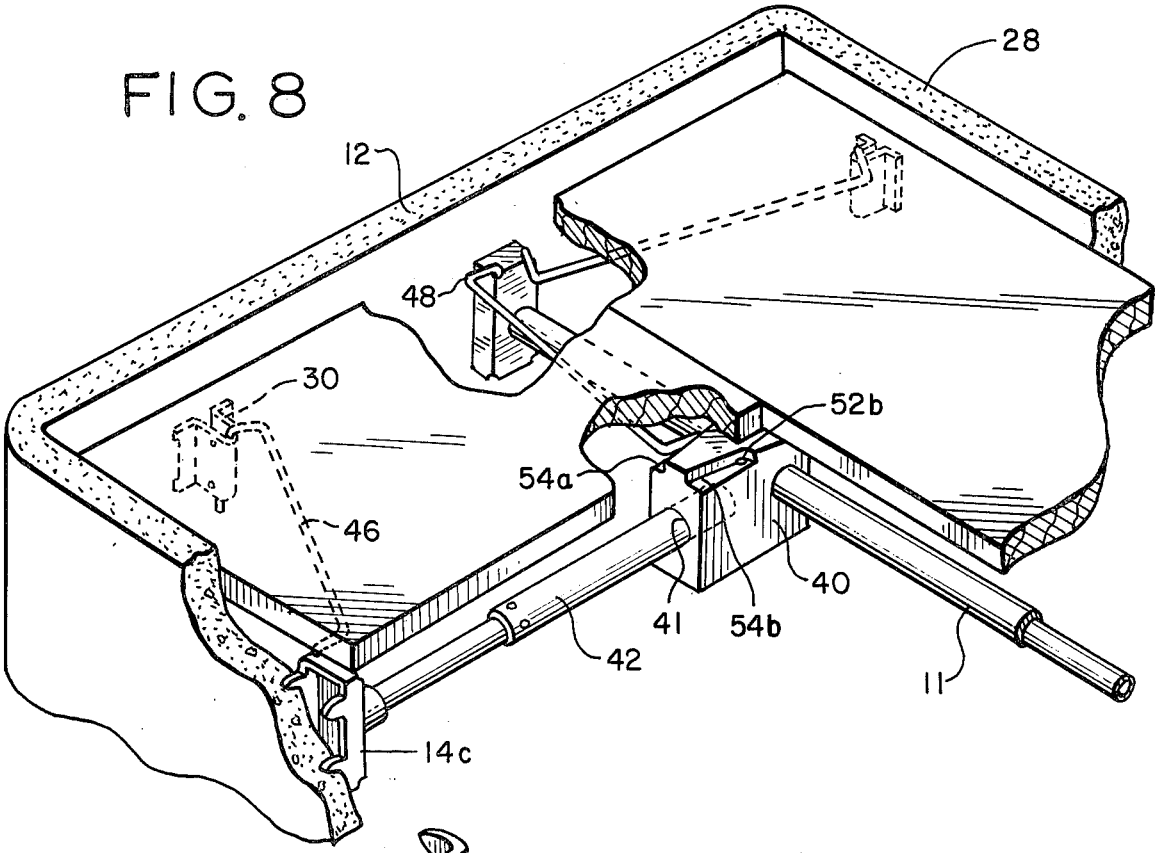
FIG. 9
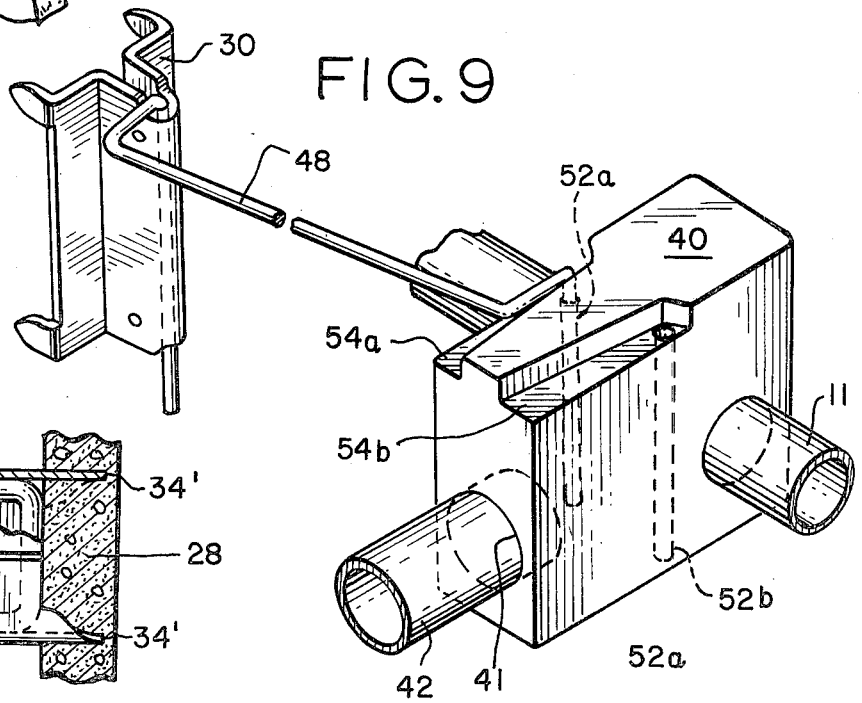
FIG. 6
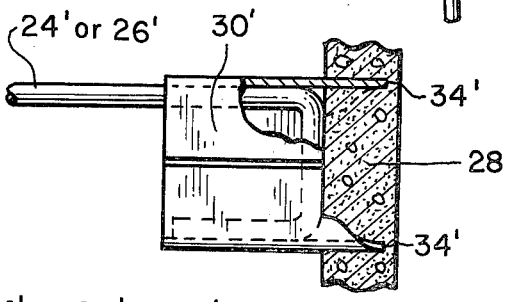
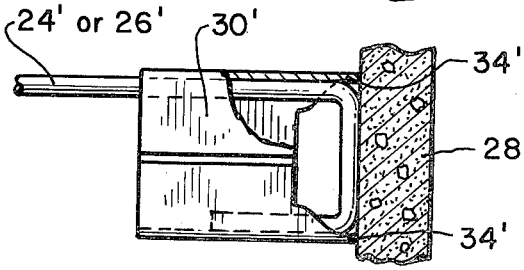
FIG. 7

CLOTHING ROD/SHELF SUPPORT UNIT

BACKGROUND OF THE INVENTION

The present invention generally relates to closet hardware and more particularly relates to adjustable clothing rods.

A wide range of closet dimensions are found in today's apartments and houses. Due to this lack of standardization, clothing rods are ordinarily cut to custom length for each closet. This naturally raises the cost of construction. Moreover, if the home owner or tenant desires to use additional areas for clothing storage, or to use additional clothing rods in an existing closet, he is met with the expense of ordering a custom-cut rod or with the chore of having to cut an oversized standard length to size.

Extensible clothing rods have been developed to meet the demand for hardware of sufficient versatility to fit a wide variety of closet sizes. These extensible rods are typically telescoping and often have some means for fixing the degree of extension.

To make use of all available closet space, shelves are ordinarily positioned directly above closet clothing rods. Brackets secured to the closet walls typically hold shelving in place. This arrangement has generally been found to be adequate for permanent shelving installation. However, where installation is only temporary, these brackets may be objectionable. Conventional installation often requires as many as four to six brackets, with each bracket being secured by several screws or nails. This arrangement not only requires the provision of a great many parts, but also upon installation results in visible damage to the walls, which is of concern to one who intends to remove the shelving at a later date. This is of primary importance to the renter who is responsible for such damage to an apartment.

It is thus a primary object of the present invention to provide a combined clothing rod/shelf support unit which is simpler and has fewer parts than conventional designs. Another object is the provision of an extensible clothing rod/shelf support unit which is mountable with a minimal amount of damage to wall surfaces. Yet another object is the provision of a closet storage apparatus which is easily assembled and mounted by one with little carpentry skill.

SUMMARY OF THE INVENTION

This invention responds to the problems presented in the prior art by providing an extensible clothing rod with mounting means at each of its ends. Pivotal brackets extend from the rod and are secured to the back closet therefrom adapted to support a shelf above the wall to support a shelf above the rod. A second embodiment includes a support block mounted to the rod, with a second extensible rod extending therefrom in a direction substantially perpendicular to the first rod toward a fourth wall which is substantially perpendicular to the opposing walls. A second set of brackets extends from the second rod toward one of the end walls, said brackets being adapted to support a second shelf. These and other objects, features and advantages of the present invention will be apparent from the following description, appended claims and annexed drawings.

BRIEF DESCRIPTION OF THE FIGURES

FIGS. 6 and 7 are side views of an alternate cleat design;

FIG. 8 is a partially broken-away perspective view of a second embodiment of the invention; and FIG. 9 is a perspective view of a modification shown in the apparatus of FIG. 8.

DESCRIPTION OF THE PREFERRED EMBODIMENTS

Figure 1:
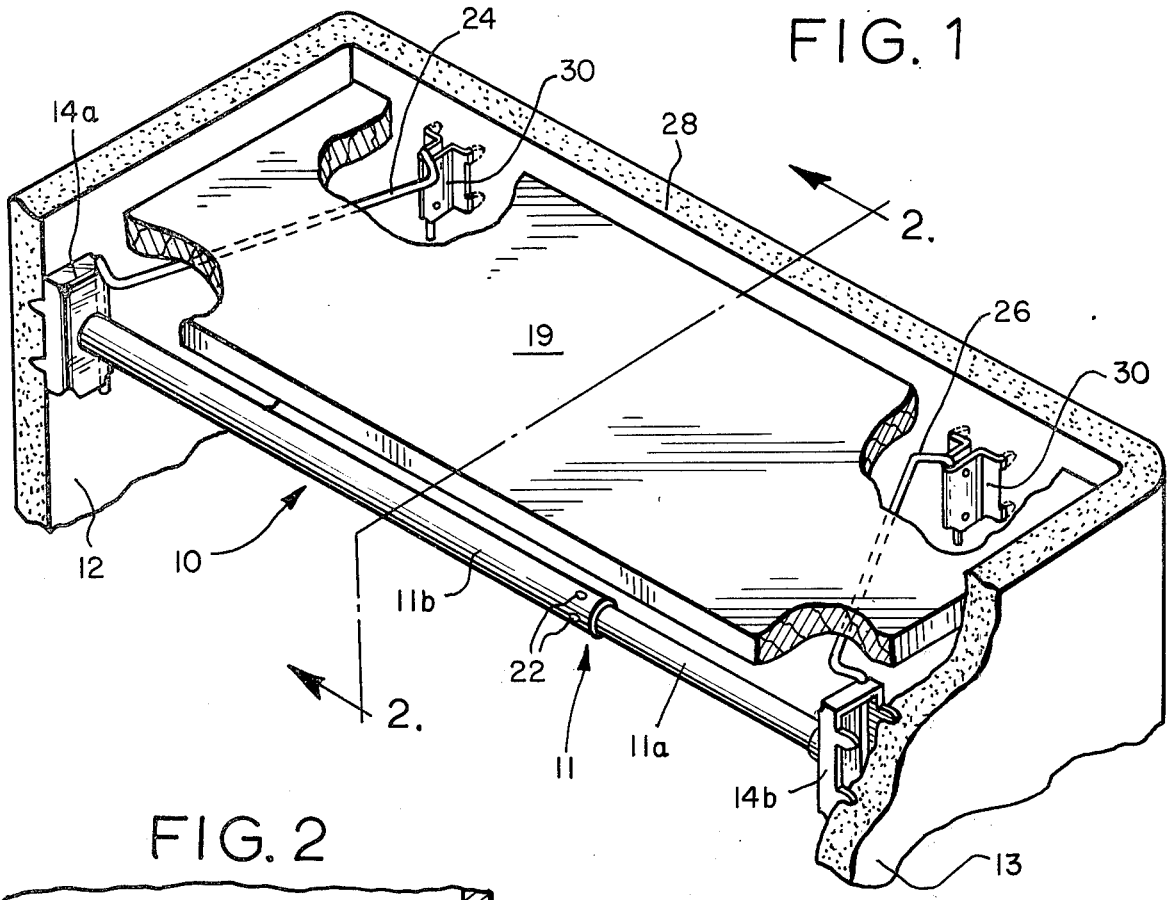
FIG. 1 is a partially broken-away perspective view of a first embodiment of the invention.
Figure 2:
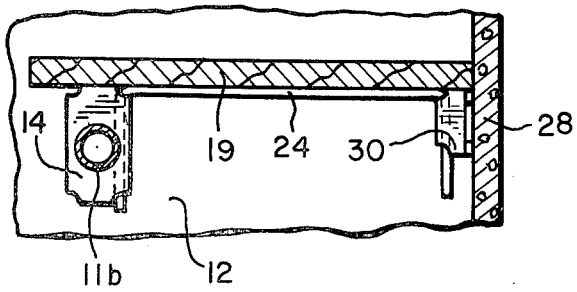
FIG. 2 is a sectional view taken along line 2—2 of FIG. 1.
Figure 3:
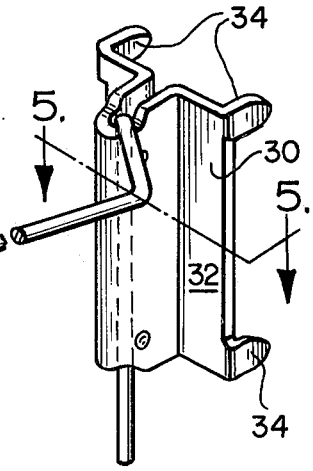
FIG. 3 is a perspective view of a portion of the apparatus of FIG. 1.
Figure 4:
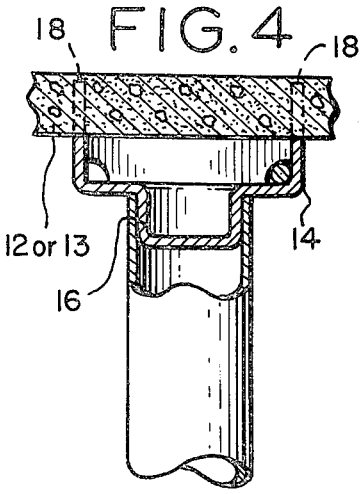
FIG. 4 is a sectional view taken along line 4—4 of FIG. 3.
Figure 4:
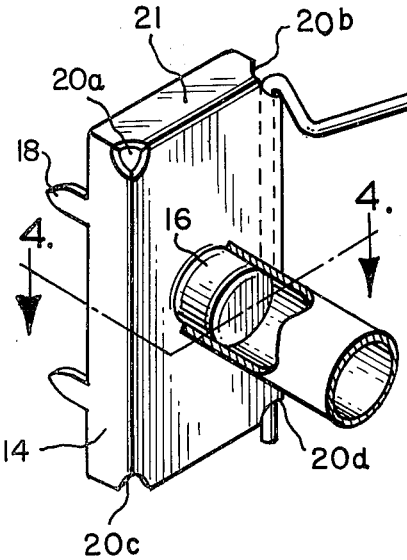
Figure 5:
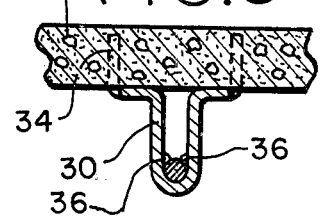
FIG. 5 is a sectional view taken along line 5—5 of FIG. 3.

In that form of the invention chose for purposes of illustration in the drawings, the clothing rod/shelf support apparatus is shown generally at 10. The first clothing rod 11 includes a male portion **11*a* and a female portion 11*b*, which is slidable with respect to the male portion. This renders the first rod 11** adaptable to closets of varying width.

Rod mounting plates are fitted to each end of the first rod 11 and are designed to anchor the rod 11 to the closet end walls 12 and 13. These plates may be simple flanges with a center aperture for insertion of the rod 11 and having screw holes for affixation to the end walls. The preferable design, however, is that shown generally at 14, specifically **14*a* and 14*b* in the drawings. These mounting plates 14*a* and 14*b* each includes a protruding neck 16 which extends toward rod 11 to receive same. Alternatively, the rod 11 may be adaptable to fit into a circular orifice (not shown) in the mounting plates. The rod 11 may be secured to each mounting plate with either design by conventional means such as welding. Each mounting plate 14*a* or 14*b* also includes a plurality of tangs 18 having sharpened ends for insertion into the closet end walls. The tangs 18 preferably are mere extensions of the mounting plates, thus providing a piece of simple configuration which will minimize wall damage. The tangs 18 should be of sufficient width to sustain the shear stresses to which they are subjected when rod 11 is loaded. The mounting plates 14 also include openings 20*a*, 20*b*, 20*c* and 20*d* which are adapted to receive brackets, as discussed in detail hereinbelow. Due to the configuration of mounting plates 14*a* and 14*b* which project above rod 11, the upper openings 20*a* and 20*c* are positioned above the rod 11 so that a shelf 19 resting on the brackets will be above the rod. The mounting plates also should extend from the wall to provide a shoulder 21** to provide additional shelf support.

When tangs are utilized as a means of affixing mounting plates **14*a* and 14*b* to end walls 12 and 13, the extensible rod 11 should be equipped with a means for securing the rod in an extended position. In the illustrated embodiment this means comprises a crimp in the tubing, shown at 22. This may be done with a conventional crimping tool. Alternatively, a dowel screw may be threaded into the male tube to engage the enterior surface of the female tube 11*b*. Another example would be the inclusion of a ring and set screw, with the ring disposed around the male tube and the set screw threaded into the ring. With any of these examples, the male and female tubes 11*a* and 11*b*** are anchored with respect to each other.

Also included in the present invention are pivoted brackets 24 and 26 which ae pivotally mounted to the first rod 11 and extend toward and are of sufficient length to reach the back wall 28 of the closet. In the preferred embodiment these brackets 24 and 26 are constructed of rigid wire, ordinarily 18 guage steel, the ends of which are bent 90° to extend vertically downward when the wire brackets are mounted. It is also preferable that each pivotal bracket 24 and 26 have a 90° bend in the horizontal plane, proximate to the mounting plate 14. This allows the user to position the brackets 24 and 26 perpendicularly to rod 11, as well as at any acute angle, as discussed more fully hereinbelow.

One end of each of the brackets 24 and 26 is inserted through the openings **20*a* and 20*b*, or 20*c* and 20*d* in the mounting plates. These openings should be undercut as depicted so that the upper surface of the brackets is in the same horizontal plane as the mounting plate shoulder 21, to provide a level shelf support. The other end of each bracket 24 and 26 is secured to the back closet wall 28 by a cleat 30. Each cleat 30 includes a body 32 which is adapted to receive the bracket end and tangs 34 to anchor the cleat 30 to the back wall 28. The cleat tangs 34 are of similar configuration to the mounting plate tangs 18. Fingers 36 extend inward from the top and bottom extremes of the cleat body 32 to maintain the position of the wire bracket 24 or 26** and to minimize deflection of same.

To use this embodiment of the invention, the rod 11 is positioned at the desired distance from the back wall 28. This distance would ordinarily be somewhat greater than half the width of the standard coat hanger but may be as great as the length of the supporting portion of brackets 24 and 26, normally not in excess of 18 inches. The mounting plates 14 are driven outward so that the tangs 18 are fully embedded in the end walls 13 and 14. The rod 11 is then crimped to securely fasten the male **11*a* and female 11*b* portions with respect to each other. The brackets 26 and 28 are inserted into the mounting plate openings with the cleats 30 mounted to the opposite end of the brackets. If the full length of the brackets are required, they would be positioned perpendicularly to the end wall 12. Otherwise the brackets would form an acute angle with the rod 11. Finally, the cleats 30 are driven into the back wall 28 and the apparatus is ready to support a shelf 19**.

A second possible cleat design is depicted in FIGS. 6 and 7 and may be preferable for some applications. The cleat 30' is mounted to a bracket 24' and 26' which is also of modified design. In this embodiment the bracket end is substantially U-shaped, with the cleat 30' slidably mounted to the sides of the "U". Tangs 34' are included to engage the wall 28. The term "slidably" is intended to describe a close fit in which the cleat 30' is movable only through heavy hand pressure or with the assistance of a tool such as a hammer. The apparatus is supplied to the user in a retracted position, shown in dotted lines as seen in FIG. 6. Installation is the same as described above except that to install the cleat 30', the bracket 24' and 26' is positioned adjacent the back wall 28, and the cleat tangs 34' are driven into the wall. This is done by tapping on the back of the cleat body 30' until the body comes into contact with the wall 28. This cleat may desirably include a slightly curved portion adjacent the cleat body 30' which abuts the wall. This enables the cleat to "click" into place when it is fully extended. This curved portion must of course, be small enough to allow the body to slide passed the U-bracket as the cleat is tapped into place. The installed position of the cleat 30' with respect to bracket 24' or 26' is shown in FIG. 7. Since this cleat 30' is not rotatable with respect to the bracket 24' or 26', it is not desirable that the cleat 30' not be positioned too far from side wall 12 or 13. That is, the angle between the bracket and the side wall should be no more than 30° or so.

A second embodiment of the present invention includes the apparatus discussed hereinabove as well as an additional clothing rod and even, if required, a second shelf which is perpendicular to the first shelf. This embodiment is only of utility in larger closets having a front wall which is perpendicular to the closet end walls.

This embodiment includes a support block 40, shown in FIGS. 8 and 9. The support block 40 has a circular opening through its width designed to receive the first extensible rod 11, and uses this rod as a means of support. The block 40 is thus positioned on the first rod 11, proximate one of the two end walls 12 or 13. The block 40 also includes a cylindrical cavity 41 designed to receive a second extensible rod 42, extending in a direction substantially perpendicular to the first extensible rod. The opposite end of this second rod 42 is supported at the front closet wall by a mounting plate **14*c* which is of the same design as mounting plates 14*a* and 14*b*, discussed hereinabove. This second rod 42 includes male and female portions, and is crimped upon installation in the same manner as first rod 11**.

A second set of pivotal brackets may, within the scope of this invention, extend toward one of the end walls (not illustrated) to provide support for a second shelf.

In the illustrated embodiment a second shelf support bracket 48 is mounted to end wall 12 adjacent first rod 11. While this bracket may be a simple extension of mounting plate **14*a*, it preferably is in the form illustrated; i.e., a rigid wire bracket extending between mounting plate 14*a* and support block 40. The upper surface of the support bracket 48 is in the same horizontal plane as the upper surface of the support block 40 and pivotal bracket 46 to provide level support for second shelf 50. This support bracket 48 has a horizontal portion designed to support the second shelf 50 and vertical positions designed to fit into openings 20*a* and 20*b* in mounting plate 14*a*. Vertical slots 52*a* and 52*b* are drilled in the support block 40 to receive the other end of the support bracket. Only one of these slots will be used at any given time. The horizontal portion of the support bracket should be offset somewhat from the vertical portion to insure an adequate ledge for support of the second shelf 50. The support block 40 is undercut at 54*a* and 54*b* to receive the offsetting portion of the support bracket 48 and to allow support bracket 48 to be pivoted if necessary. If the second rod 42 is to be positioned closer to end wall 12 than the length of the support bracket 48, then this bracket will have to be positioned at some acute angle with respect to second rod 42 and another cleat (shown in FIG. 9) will be necessary to mount the other end of this bracket to wall 12**.

In the illustrated embodiment an optionally included second shelf pivotal bracket 46 is shown in phantom as extending from second rod mounting bracket **14*c* toward end wall 12. Bracket 46 is normally of the same configuration as brackets 26 and 28 or 26' and 28'. Bracket 48 is mounted to end wall 12 by a cleat 30**, of the same configuration as either of the cleat designs described above.

To assemble this second embodiment of the invention, the support block 40 must be positioned on the first rod 11 before the first rod is mounted to the end walls 12 and 13. The first rod 11, along with its pivotal brackets 26 and 28 and cleats 30, may then be mounted. The support block 40 is positioned at the desired distance from wall 12 which, ordinarily, equals the horizontal supporting length of support bracket 48. The second extensible rod is slid into cavity 41 and mounting plate 14c is driven into the front closet wall. Finally, pivotal bracket 46 and its cleat 30 are mounted in the same manner as with the first embodiment. If the second rod is desired to be closer to the end wall 12, then both pivotal bracket 46 and support bracket 48 will be positioned at some acute angle with respect to the second rod, and an additional cleat is used to mount the support bracket 48 to the wall 12.

What is claimed is:

1. A clothing rod/shelf support unit comprising:

a first extensible clothing rod adapted to extend between a first and a second opposing end wall in the vicinity of a back wall which is between said opposing walls, said rod including means for securing said rod to said opposing walls;

pivotal brackets mounted to said rod extending toward said third wall, said brackets being adapted to support a shelf above said rod; and means for securing said pivotal brackets to said back wall.

2. The clothing rod/shelf support unit of claim 1 further comprising means for securing said rod in an extended position.

3. The clothing rod/shelf support unit of claim 1 wherein said means for securing said rod to said opposing walls projects above said rod and said pivotal brackets extend therefrom.

4. The clothing rod/shelf support unit of claim 1, further comprising:

a support block mounted on said rod proximate to said first wall; and a second extensible rod secured to said support block and extending therefrom in a direction substantially perpendicular to said first extensible rod toward a fourth wall which is substantially perpendicular to said opposing walls.

5. The clothing rod/shelf support unit of claim 4, further comprising:

a second set of pivotal brackets extending toward and of sufficient length to reach said first wall, one of said brackets being pivotally mounted to said second rod, and another of said brackets pivotally mounted to said support block, said second set of brackets being adapted to support a second shelf above said second rod; and means for securing said second set of pivotal brackets to said first wall.

6. The clothing rod/shelf support unit of claim 1, further comprising:

a support block mounted on said rod;

a second extensible rod secured to said support block and extending therefrom in a direction substantially perpendicular to said first extensible rod toward a fourth wall which is substantially perpendicular to said opposing walls, said second rod including means for securing said second rod to said fourth wall;

a second shelf pivotal bracket extending from said second rod toward and of sufficient length to reach said first opposing wall, the upper edge of said second shelf pivotal bracket being in the same horizontal plane as the upper edge of said support block;

means for securing said second shelf pivotal bracket to said first wall; and a second shelf support bracket mounted to said first wall adjacent said first rod, the supporting edge of said second shelf support bracket being in the same horizontal plane as the upper edge of said support block and said second shelf pivotal bracket so that a substantially horizontal second shelf may be positioned thereabove.

7. The clothing rod/shelf support unit of claim 6 wherein said means for securing said first and second rod to said opposing walls and said fourth wall, respectively, project above said rods, with each of said pivotal brackets extending from one of said means, and with said second shelf support bracket extending from said means for securing said first rod to said first wall.

8. The clothing rod/shelf support unit of claim 6 wherein said second shelf support bracket extends from said first wall to said support block.

9. The clothing rod/shelf support unit of claim 6, further comprising means for securing said first and second rods in extended positions.

10. In an adjustable clothing rod of the type having a first extensible rod adapted to fit between a first and a second opposing wall proximate to a third wall extending between said opposing walls, and including means for securing said first rod to said opposing walls, the improvement comprising:

brackets mounted to said first rod extending toward said third wall adapted to support a shelf above said first rod, said brackets being adjustable so that said first rod may be positioned at various distances from said third wall, and means for securing said brackets to said third wall.

11. The clothing rod of claim 9 wherein said brackets are pivotally mounted to said first rod.

12. The clothing rod of claim 9, further comprising a support block mounted to said first rod, a second extensible rod secured to said support block and extending therefrom in a direction substantially perpendicular to said first rod toward a fourth wall, and means for mounting said second rod to said fourth wall.

13. The clothing rod of claim 12, further comprising a second set of substantially horizontal brackets mounted to said first wall adapted to support a second shelf above said second rod, at least one of which extends between said second rod and said first wall, and one of which extends between said support block and said first wall.

14. The clothing rod of claim 12 wherein said means for mounting said first and second rods to said walls extend above said rods, and each of said brackets is mounted to one of said walls at one of said rod mounting means.

* * * * *

UNITED STATES PATENT OFFICE

CERTIFICATE OF CORRECTION

Patent No. 4,125,078 Dated November 14, 1978

Inventor(s) Larry M. Nyquist

It is certified that error appears in the above-identified patent and that said Letters Patent are hereby corrected as shown below:

Column 3, line 2, delete "ae" and insert -- are --.

Column 4, line 67, delete "48" and insert -- 46 --.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*